US011170919B2

(12) United States Patent
Cui et al.

(10) Patent No.: US 11,170,919 B2
(45) Date of Patent: Nov. 9, 2021

(54) NEAR NET SHAPE BULK LAMINATED SILICON IRON ELECTRIC STEEL FOR IMPROVED ELECTRICAL RESISTANCE AND LOW HIGH FREQUENCY LOSS

(71) Applicant: Iowa State University Research Foundation, Inc., Ames, IA (US)

(72) Inventors: Jun Cui, Ames, IA (US); Gaoyuang Ouyang, Ames, IA (US); Brandt Jensen, Ames, IA (US); Kevin W. Dennis, Ames, IA (US); Baozhi Cui, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 82 days.

(21) Appl. No.: 16/501,332

(22) Filed: Mar. 27, 2019

(65) Prior Publication Data

US 2019/0304647 A1 Oct. 3, 2019

Related U.S. Application Data

(60) Provisional application No. 62/761,709, filed on Apr. 3, 2018.

(51) Int. Cl.

| | |
|---|---|
| ***H01F 1/147*** | (2006.01) |
| ***B22F 1/00*** | (2006.01) |
| ***B22F 1/02*** | (2006.01) |
| ***C22C 38/02*** | (2006.01) |
| ***B22F 3/14*** | (2006.01) |

(52) U.S. Cl.

CPC ..... *H01F 1/14783* (2013.01); *B22F 1/0055* (2013.01); *B22F 1/02* (2013.01); *B22F 3/14* (2013.01); *C22C 38/02* (2013.01); *H01F 1/1475* (2013.01); *B22F 2301/35* (2013.01); *B22F 2302/25* (2013.01); *B22F 2302/45* (2013.01); *B22F 2304/15* (2013.01); *C22C 2202/02* (2013.01)

(58) Field of Classification Search

None

See application file for complete search history.

(56) References Cited

U.S. PATENT DOCUMENTS

2012/0049100 A1* 3/2012 Yonetsu ..... H01F 1/26 252/62.54

2019/0283127 A1* 9/2019 Kinouchi ..... B22F 1/0018

OTHER PUBLICATIONS

J.A. Bas et al, Sintered soft magnetic materials. Properties and applications, Journal of Magnetism and Magnetic Materials, 254, 391-398, 2003.

(Continued)

*Primary Examiner* — Xiaobei Wang

(57) ABSTRACT

The invention involves producing discontinuous, flake-shaped particles of a soft magnetic material, coating the flake-shaped particles with an electrically insulating coating, and consolidating the coated flaked-shaped particles to form a soft magnetic bulk shape. The consolidated bulk shape can comprise a layer or a simple or complex 3D magnet part shape, which has a consolidated layered microstructure that includes laminated soft magnetic regions that are substantially encapsulated by an electrical insulating layer to increase the resistivity of soft magnetic material, especially when used in silicon iron magnet parts.

18 Claims, 6 Drawing Sheets

(56) References Cited

OTHER PUBLICATIONS

Y.F. Liang et al, Fabrication of Fe—6.5wt% Si Ribbons by Melt Spinning Method on Large Scale, Advances in Materials Science and Engineering, vol. 2015.
Hao-Ze Li et al, Microstructure, Texture Evolution, and Magnetic Properties of Strip Casting Nonoriented 6.5 wt.% Si Electrical Steel Sheets With Different Thicknesses, IEEE Transactions on Magnetics, vol. 51, No. 11, Nov. 2015.
K.I. Arai et al, Recent developments of new soft magnetic materials, Journal of Magnetism and Magnetic Materials, 133, 233-237, 1994.
T.Ross-Yanez et al, Production of high silicon steel for electrical applications by thermomechanical processing, Journal of Materials Processing Technology, 141 [1] 132-137, 2003.
T. Yamaji et al, Magnetic properties and workability of 6.5% silicon steel sheet manufactured in continuous CVD siliconizing line, Journal of Magnetism and Magnetic Mateirals, 133, 1994.
G. Ouyang et al, Review of Fe—6.5 wt% Si high silicon steel—A promising soft magnetic for sub-kHz application, Journal of Magnetism and Magnetic Materials, 481, 234-250, 2019.
A. Aharoni, Demagnetizing factors for rectangular ferromagnetic prisms, Journal of Applied Physics, 83, 3432, 1998.

* cited by examiner

NEAR NET SHAPE BULK LAMINATED SILICON IRON ELECTRIC STEEL FOR IMPROVED ELECTRICAL RESISTANCE AND LOW HIGH FREQUENCY LOSS

RELATED APPLICATION

This application claims benefit and priority of provisional application Ser. No. 62/761,709 filed Apr. 3, 2018, the entire disclosure of which is incorporated herein by reference.

CONTRACTUAL ORIGIN OF THE INVENTION

This invention was made with support under Grant No. DE-EE0007794 awarded by the Department of Energy. The government has certain rights in the invention.

FIELD OF THE INVENTION

The present invention relates generally to near net shaping of electric steels to produce a laminated or layered microstructure. More particularly, the invention relates to discontinuous silicon iron flakes that are coated with an insulating inorganic or organic coating before consolidation into a near net bulk shape with the brick wall type of structure having enhanced electrical resistivity and high frequency performance.

BACKGROUND OF THE INVENTION

The development of high frequency electric motor, transformers and inductors imposes a critical requirement on the magnetic materials used for higher power density and efficiency. The high frequency operation brings improvement in horsepower and power density, but it comes with a tradeoff of high iron loss. Iron loss includes hysteresis loss, eddy current loss, and excess loss, all of which increase with increasing frequency. Among the total loss, eddy current loss occupies the largest portion at high frequency, as it increases to the square of frequency. With a fixed frequency, one may decrease flux density, decrease the thickness or increase the resistivity to reduce the eddy current loss. Flux density is an intrinsic materials property. In most cases, high flux density is preferred. To satisfy the thin thickness requirement, silicon steel is rolled into sheet less than 0.15 mm thickness for use in high speed motors. Further reduction of the thickness through rolling is not beneficial due to the rolling cost, additional handling cost, and low stacking efficiency. The electric resistivity need be improved to decrease the eddy current loss.

To balance the cost and the physical properties, silicon iron electric steel has been the best choice. Silicon iron electric steel is an iron base alloy which may contain zero to 9 wt. % silicon. Low silicon steel, i.e. 3.2 wt. % silicon steel, is currently widely used in transformers and electric machines. It has excellent mechanical properties, which allows silicon steel slabs coming out from a casting machine to be directly hot rolled then cold rolled to thin sheets. A higher amount of silicon addition, i.e. 6.5 wt. %, results in higher electrical resistivity. The electrical resistivity increases from 52 μΩ-cm to 82 μΩ-cm when silicon content is increased from 3 wt. % to 6.5 wt. % (reference 1). In addition, magnetostriction, as additional source of conversion loss, is reduced from 8 ppm to 0.1 ppm. However, high silicon steel suffers from poor ductility, which prohibits any type of direct cold work and imposes additional tooling cost.

Due to the significant electrical resistivity, high silicon steel has recently received great attention both from research institutes and industry. The majority of high silicon steel research focuses on solving the brittleness problem. It is now accepted that the poor mechanical properties of high silicon steel originates from the formation of ordered phases during cooling, where a disorder-to-order transformation occurs. This disorder-to-order transformation must be avoided to produce ductile sheet of high silicon steel. Various approaches to suppress this disorder-to-order transition have been explored. Some utilize a sophisticated thermal mechanical processing schedule (reference 2), while others utilize rapid solidification techniques such as melting spinning (reference 3) or strip casting (reference 4). Production of ductile ribbons has been reported using these techniques, but none of the above mentioned methods has produced large quantity of sheet due to limitation in productivity and cost of the method. JFE Steel Corporation pioneers in the mass production of high silicon steel by a process where excess silicon is deposited on the surface of ductile low silicon steel sheet using chemical vapor deposition (CVD) techniques. To achieve uniform distribution of the silicon throughout the thickness of the steel sheet, a diffusion annealing is followed after the CVD process (reference 5). However, the CVD process has limitation in thickness, width, productivity, cost, and environmental impact.

Regardless of which grade is used, electric steel is made thin in thickness to reduce the eddy current loss. For use in a final service application, the thin laminates have to be individually coated by insulating coatings before being stacked together to form the so called stacked laminates. To satisfy the requirement in shape and dimension prescribed by the magnetic flux path, the laminates need to be machined then annealed to remove the stress that causes performance degradation. For example, electric steel is usually stamped into "E" and "I" shapes for the application for electric transformers, or stamped into a "tooth" pattern for the application for electric machines. The stamping of electric steel leaves small damage to the edge of the laminate, causing an increase in coercivity and irregular magnetic flux. It also causes significant wear on the stamping tool. The damage to the laminate and to the tool gets worse quickly as the material gets more brittle. In addition, due to the absence of actual bonding, the stacked laminates lack adequate mechanical properties. Other machining methods include water jet and electric discharge machining. Both are high-cost high-precision methods typically reserved for high-end system.

Toward reaching the goal of near net processing, the powder metallurgy route has been used in the field of soft magnetic materials. In this process, the powder compact is molded into final shape from granular powders and then sintered to achieve densification. The sintered soft magnetic finds wide application in the automotive industry and household items such as ABS sensor ring, pump angle sensor, step motor; cores for dimmer switches, contact plates, heater valves, relay armatures, and printer heads (reference 6). However, the performance of such sintered soft magnetic materials is poor in high-frequency AC applications due to their high total-losses. To reduce the total losses, a second generation of soft magnetic materials has been commercially developed wherein powder granules are produced by gas or water atomization and coated by an inorganic or organic chemical insulation material before compacting into final parts. Both hot and cold compressing techniques were used to produce a final part. This second generation of soft magnetic material offers a huge improvement in iron loss reduction compared to the first generation due to the extremely high resistivity contributed by the electrically insulating coating and binding matrix. However, this second generation of soft magnetic material suffers from low mechanical strength, poor thermal stability, and diluted magnetic properties. A new method that facilitates near net shape processing of silicon electric steel that possesses high electric resistivity and good mechanical properties is in great demand.

In contrast to the stack lamination and powder metallurgy route mentioned above, the present invention provides embodiments that introduce the application of macroscopic high aspect ratio flakes as the building blocks for the soft magnetic bulk parts. Ductile thin flakes can be prepared directly through a melt spinning process where the sophisticated and energy consuming rolling processes required in the laminates making processes is eliminated. And compared with the typical melt spinning process for continuous and wide ribbon production, where sophisticated control of heating, nozzle and collection mechanisms are required, melt spinning process for flake production is relatively simple and free of limitation in size and shape. The usage of microscopic flakes also allows complex shape bulk part to be made similar to that of powder metallurgy route. Compared to using powder granules in the powder metallurgy route, the usage of flake-shaped particles pursuant to embodiment of the invention opens one more dimension to engineer the anisotropy. This anisotropy can be crystalline anisotropy resulted from the rapid solidification process and later carried on to the final part; or the shape anisotropy that is natural to the shape of the high aspect ratio flakes, all of which allow further tuning and improvement of magnetic properties. The usage of high aspect ratio flakes and thin insulating coating pursuant to embodiments of the invention also provides new insights to increase the mechanical strength, thermal stability, and reduces magnetic dilution of the soft magnetic bulk part as compared to polymer bonded powder cores currently available.

SUMMARY OF THE INVENTION

The present invention involves in one embodiment particular discontinuous, soft magnetic flake-shaped particles having an electrically insulating coating on the particles and their use in a method for producing a soft magnetic bulk shape part. A method embodiment includes coating the soft magnetic flake-shaped particles with an electrically insulating coating and consolidating the coated particles to form a soft magnetic bulk shape part. The soft magnetic bulk shape part produced by consolidation can comprise a consolidated flat or non-flat layer and a simple or complex 3D (three dimensional) shape to a desired near net magnet part shape.

Practice of the present invention can produce a consolidated soft magnetic shape that comprises a layered microstructure that includes laminated soft magnetic regions (formerly the coated flake-shaped particles) that are substantially encapsulated by an electrical insulating layer (formerly the electrically insulating particle coating) between adjacent soft magnetic regions to increase electrical resistivity and magnetic permeability, and reduce energy loss as well as improve high frequency performance.

The present invention envisions in another embodiment a composite soft magnetic bulk magnet structure for use in electrical transformers, generators, motors, alternators, inductors, and the like. The bulk structure comprises a plurality of the stacked layers consolidated as described above wherein each stacked layer comprises the laminated soft magnetic regions (formerly the coated flake-shaped particles) that are encapsulated by the electrically insulating layer (formerly the electrically insulating particle coating) and wherein each stacked layer is separated from the next adjacent stacked layer by a relatively thick electrically insulating inter-layer.

The bulk structure is useful for AC electrical transformers, generators, motors, alternators, inductors, and the like to reduce energy loss, increase permeability and improve high frequency performance.

Other embodiments and advantages of practice of the present invention will become more readily apparent from the following detailed description taken with the following drawings.

DETAILED DESCRIPTION OF THE INVENTION

An embodiment of the present invention involves a method for producing a soft magnetic bulk shape part using soft magnetic flake-shaped particles typically comprising an electrical steel and having an electrically insulating coating on the particles. A method embodiment involves producing the flake-shaped particles, coating the flake-shaped particles with an electrically insulating coating, and consolidating the coated flaked-shaped particles to form a soft magnetic bulk shape such as including, but not limited to, a flat or non-flat layer, a simple 3D shape, a complex 3D shape as a desired near net bulk magnet part shape.

The flake-shaped particles can be produced as rapidly solidified soft magnetic flake-shaped fragments and then coated with inorganic or organic electrically insulating material. For purposes of illustration and not limitation, the flake-shaped particles can be produced by melt spinning a melt stream on a grooved wheel, or multiple melt streams on a wide grooved wheel, wherein the melt stream is fragmented and ejected from the wheel as as-rapidly solidified flakes. Alternately, the particles can be produced by melt spinning a rapidly solidified, continuous ribbon and then fragmenting the ribbon into rapidly solidified flakes. Alternatively, the flake-shaped particles can be produced by machining, such as cutting or milling, of a bulk form (e.g. a casting or powder metal body) of electrical steel to produce machined flake-shaped particles.

Figure 1:
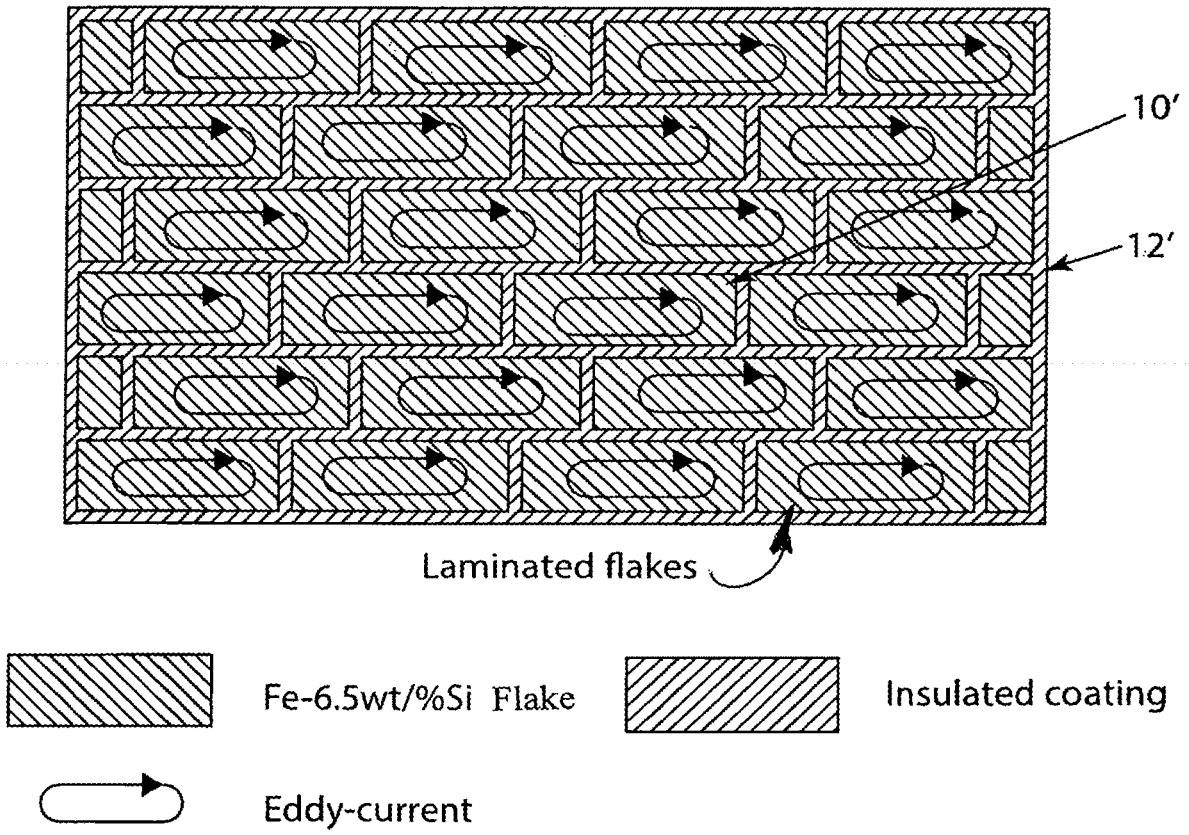
FIG. 1 is a schematic representation a local region of a consolidated soft magnet shape having the "brickwall" layered microstructure that includes laminated soft magnetic regions (formerly the coated flake-shaped particles) that are substantially encapsulated by an electrical insulating layer (formerly the electrically insulating particle coating) to increase electrical resistivity and reduce energy loss pursuant to an illustrative embodiment of the present invention. The path of eddy currents is illustrated.

The flake-shaped particles are consolidated to produce a soft magnetic bulk shape that includes, but is not limited to, a flat or non-flat layer, a simple 3D shape, and a complex 3D shape as a desired near net shape magnet part. Consolidation can be done by hot pressing. The consolidation can also be implemented by cold or warm isostatic pressing, and followed by optional sintering. The soft magnetic bulk shape comprises a layered microstructure that includes laminated soft magnetic regions 10' (formerly the coated flake-shaped particles 10", FIG. 2*b*) that are substantially encapsulated by an electrical insulating layer 12' (formerly the electrically insulating coating 12') between adjacent soft magnetic regions, FIGS. 1 and 5*a*, 5*b*. The laminated soft magnetic regions 10' are characterized by thin, flattened, elongated discreet regions having a high aspect ratio as a result consolidation of the flake-shaped particles. The consolidated layered microstructure exhibits high resistivity and results in reduction of eddy currents due to the presence of the laminated soft magnetic regions 10' (formerly the coated flake-shaped particles 10", FIG. 2*b*) that are substantially encapsulated by the electrical insulating layer 12'. Practice of the present invention can be used to form consolidated soft magnetic bulk shapes for use in electrical equipment applications such as electrical transformers, generators, motors, sensors, inductors, and alternators as a result of their increased electrical resistivity and reduced energy loss as well as high frequency (AC) performance such as at 400 Hz and higher.

The consolidated soft magnetic bulk shape may be annealed at elevated temperature and appropriate atmosphere to relieve stress, adjust weight fraction of the ordered and disordered phases, and if desired, grow grains of the microstructure to improve magnetic properties.

An illustrative method embodiment of the present invention begins with melting of a suitable iron or steel composition, which can be selected from at least one of pure iron and iron alloys that include, but are not limited to, iron-silicon alloys especially iron-high silicon alloys, iron-silicon-aluminum alloys, iron-nickel alloys, iron-cobalt alloys. Certain preferred embodiments employ iron silicon alloys wherein the silicon content is relatively high compared to hot/cold rolled iron silicon electrical steel, such as for example in the range of about 5 to about 6.5 weight % Si with balance being essentially iron and unavoidable impurities, although the invention can be practiced with lower silicon contents such as an iron silicon alloy having about 3 to about 6.5 weight % Si. However, practice of the invention is not limited to these soft magnetic materials and can embody soft magnetic materials that include, but are not limited to, other Fe based metal alloys, Ni based metal alloys, or Co based metal alloys or Fe, Ni, or Co containing ferrites wherein such soft magnetic materials are those that are easily magnetized and de-magnetized and typically exhibit an intrinsic coercivity less than 1000 $Am^{-1}$.

Figure 2A:
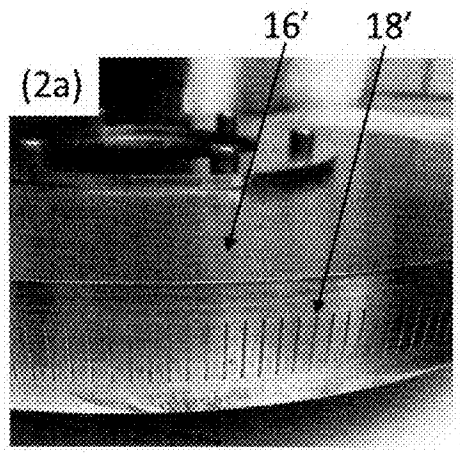
FIG. 2*a* shows a grooved melt spinning copper wheel for making as-rapidly solidified flake fragments.
Figure 2B:
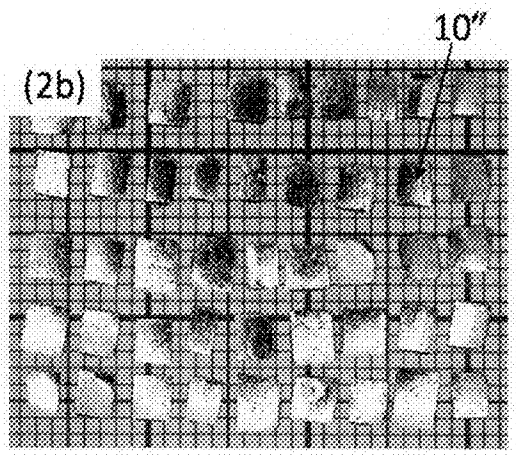
FIG. 2*b* shows discontinuous flake-shaped particles produced as flake fragments using the grooved copper wheel.
Figure 2C:
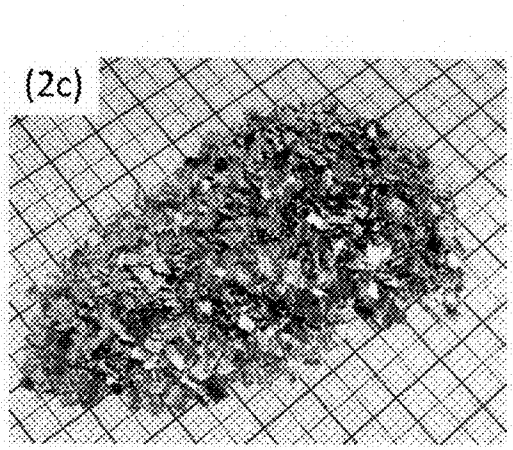
FIG. 2*c* shows a large quantity of the discontinuous flake-shaped particles produced using the grooved copper wheel.

Practice of an illustrative embodiment of the invention begins by melt spinning the molten iron or electrical steel; for example, an iron-6.5 weight % Si steel, on a rotating metal (e.g. copper, steel, etc.) wheel 16' that is water-cooled or non-cooled and grooved on its surface to produce rapidly solidified discontinuous, flake-shaped particles 10"; see FIGS. 2*a*, 2*b*, and 2*c* for purposes of illustration. Alternatively, the flake-shaped particles can be produced by melt spinning at a cooling rate of at least 10,000° C./s to produce a rapidly solidified, continuous ribbon of the iron or electrical steel on a rotating metal wheel devoid of grooves and then fragmenting the continuous melt spun ribbon; for example, by cutting the melt spun ribbons into flake fragments. A still further embodiment envisions machining, such as cutting or milling, a bulk form (e.g. a casting or powder metal body) of the electrical steel to produce machined flake-shaped particles.

For purposes of illustration and not limitation, to produce flake-shaped particles of iron-6.5 weight % silicon electrical steel in small quantity, one efficient route is through melt spinning. In melt spinning, the high silicon electrical steel is heated at least to its liquidus temperature in a crucible using inductive heating and then ejected through a small orifice onto the rotating water-cooled copper wheel devoid of grooves. The thin continuous ribbon produced is ductile due to the suppression of an unwanted ordered phase formation as a result of the rapid cooling of the molten steel. Different from fabricating nano-crystalline or amorphous material where rapid cooling is necessary for suppressing grain formation or grain growth, embodiments of the invention seek to suppress the formation of the ordered phases. For 6.5 weight % steel, a large grain size (greater than 0.05 mm) is preferred. The ductility of the ribbon allows it to be easily fragmented (e.g. cut or chopped) into flake-shaped particles utilizing a paper cutter and scissors.

However, when a large quantity of the flaked-shaped particles is demanded, these can be produced directly by melting spinning using the rotating, water-cooled grooved wheel 16' having a plurality of machined grooves 18' with desired spacing on the rotating wheel. FIG. 2*a* shows an example of such a rotating water-cooled, grooved wheel 16' where the individual grooves 18' have a width of 10 mm and depth of 0.1 mm and are spaced circumferentially apart by 2.7 mm. The grooved wheel surface is efficient in breaking or fragmenting the liquid steel stream into small segments. Upon further traveling along the circumference of the rotating wheel, the liquid segments then are rapidly solidified into individual flake-shaped particles, FIG. 2*b*, which are ejected from the rotating wheel. With proper control of the process parameters, the flake-producing process can produce nearly identical flake shapes. Among the many parameters, wheel speed, ejection pressure, ejection temperature and orifice size are the most important ones. For example, to produce the iron-6.5 weight % silicon flake-shaped particles, a wheel rotational speed of 8 m/s wheel speed, 40 Torr ejection pressure, 1590° C. ejection temperature, and 2.7 mm orifice size were found appropriate for flake mass production using melt spinning.

Mass production of flake may start with melting the metals in a melting furnace, then transfer the molten metal with a ladle, then top pour or bottom pour the melt into a tundish with a wide slit or many orifices in the bottom. The melt flows through the openings and comes into contact the spinning metal wheel to complete the rest of the melt spinning process. For mass production, the melt spinning wheel could be wide, e.g., 0.5 m, to accommodate wide stream or multiple stream branches of melt from the tundish openings. The number of orifices could be more than 20. The metal wheel for mass production can be water-cooled or non-cooled copper or steel wheel.

The discontinuous flake-shaped particles 10" are characterized as having a thin peripheral edge in the particle thickness direction and opposite major sides of relatively large area compared to that of the edge, FIG. 2*b*. For purposes of illustration and not limitation, the flake-shaped particles 10" can have an edge thickness of 0.02 to 0.2 mm and major sides with a width of 0.5 to 3 mm and a length of 1 to 5 mm. The flake-shaped particles 10" preferably have an aspect ratio of at least about 10.

Figure 3A:
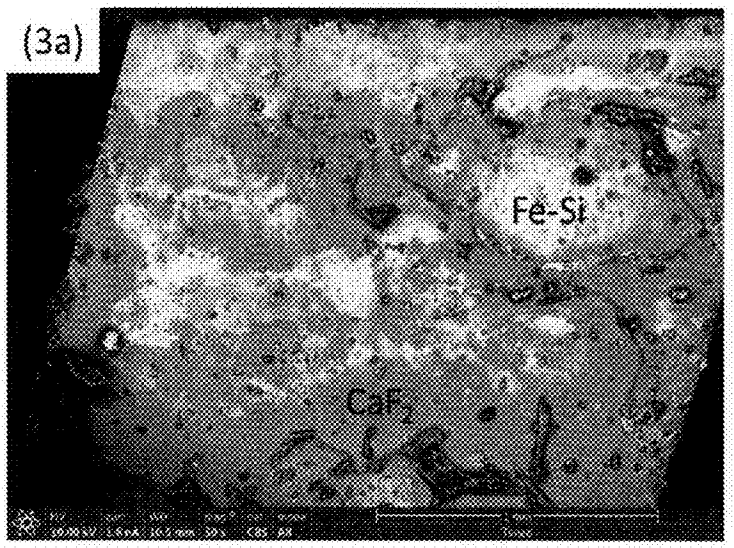
FIGS. 3*a* and 3*b* show low magnification (50×) and high magnification (500×) images, respectively, of $CaF_2$-coated discontinuous flake-shaped particles.
Figure 3B:
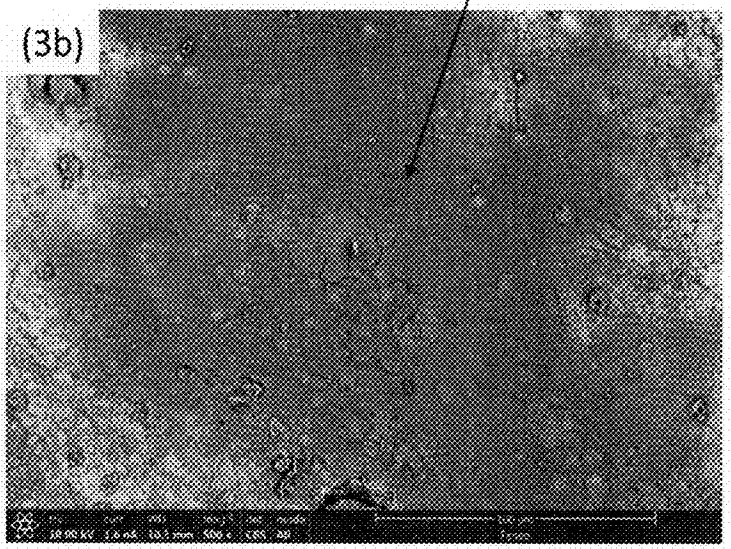

Pursuant to practice of embodiments of the invention, the discontinuous flake-shaped particles 10" then are coated with an inorganic electrical insulating coating 12' by physical and/or chemical methods. The insulating coating on each particle is thin with a thickness in the range of 0.1 to 50 μm. For purposes of illustration and not limitation, an aqueous solution of $CaF_2$ is found a viable route to coat the individual particles. For example, the flake-shaped particles are treated with $Ca(NO_3)_2$ (calcium nitride) aqueous solution, where KF (potassium fluoride) aqueous solution is added to the mixture to form the $CaF_2$ coating on each particle. The particles are placed in a beaker under continuous shaking by an orbital shaker where the two solutions are added. The treatment includes two minutes of soak in $Ca(NO_3)_2$ aqueous solution and two minutes of reaction and coating after the KF (potassium fluoride) has been added. Then the coating solution is drained to terminate the coating process. After washing and drying, the $CaF_2$-coated flake-shaped particles are ready for later consolidation. Scanning electron micrograph images of the coated particles are shown in FIGS. 3*a* and 3*b* at low and high magnifications, respectively, and show that a majority of the flake particle is covered by a layer showing grey contrast, which was confirmed by EDS to be $CaF_2$. The higher magnification image in FIG. 3(*b*) reveals the smooth coverage of the surface insulating film or layer with minimum agglomeration. An alternative coating technique can involve dipping the flake-shaped particles in an MgO-ethanol suspension, followed then by heat treatment to achieve formation of a magnesium silicate coating on the particles before a subsequent consolidation step. Other coating methods such as physical vapor deposition, chemical vapor deposition, in-situ chemical deposition, thermal/cold spraying, ball milling, and pack cementation may also be used to coat insulating coatings on the particles.

To consolidate the coated flake-shaped particles into desired high-density soft magnetic bulk shape, hot pressing and other hot consolidation techniques can be used. Hot pressing can be conducted using a die-plunger heated to the desired hot pressing temperature. For purposes of illustration and not limitation, a mass of the $CaF_2$-coated, iron-6.5 weight % Si particles was placed in a heated cylindrical die and pressed by the plunger at a hot pressing temperature of 850° C. and pressure of 43.7 MPa to achieve high densification, such as a density of 98% or higher of the hot pressed bulk shape. A 91% or higher densification can be achieved using the MgO-coated flake-shaped particles and using similar hot pressing parameters to form the hot pressed bulk shape. The density was measured by Archimedes method. Densification was calculated by dividing measured density by theoretical density (7.48 g/cc). With the addition of thin insulating particle coating, the true density is lower than theoretical density, which may result in underestimation of the real densification.

Figure 4B:
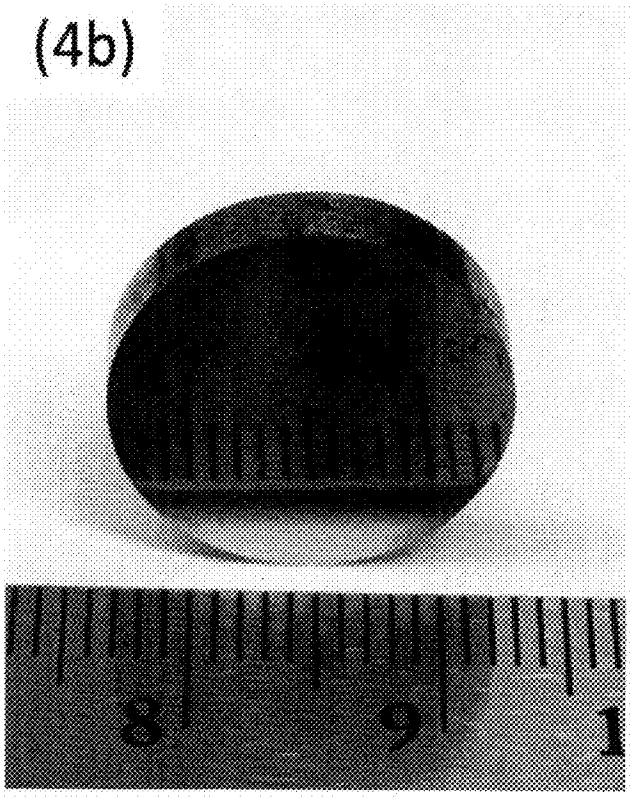
FIG. 4*a* (top view) and FIG. 4*b* (side view) are photographs of a cylindrical, disk-shaped hot pressed sample.
Figure 4A:
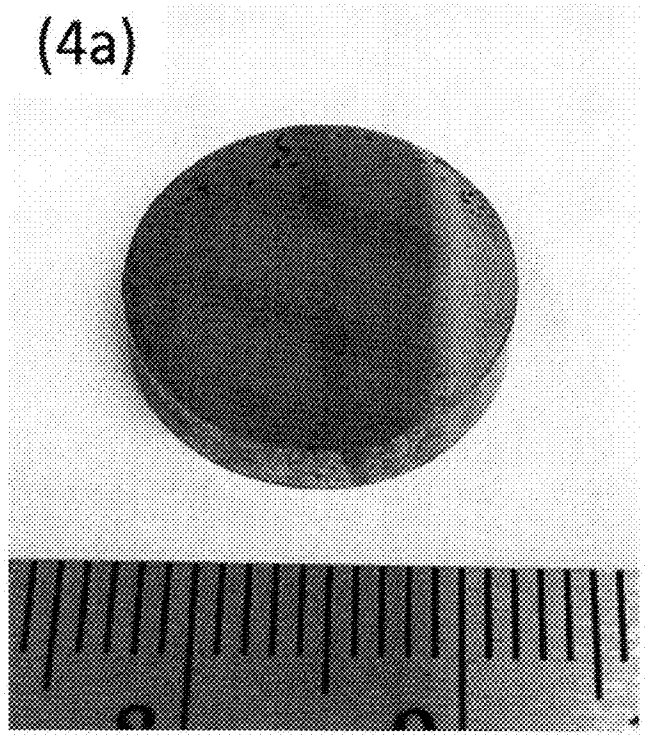
Figure 5B:
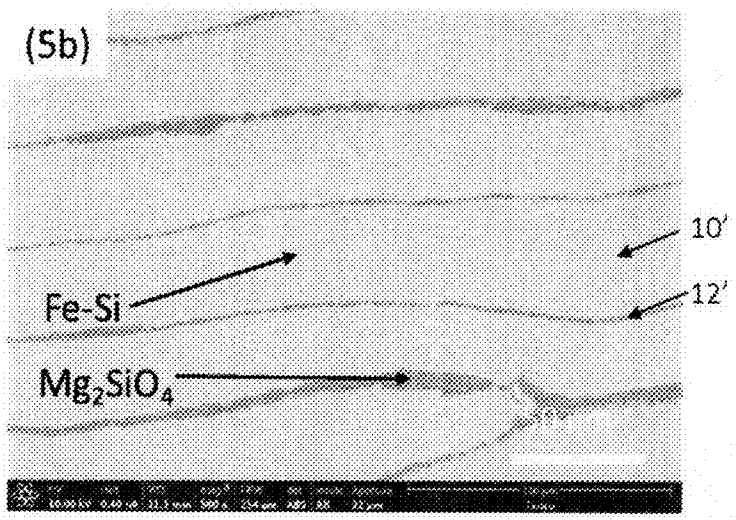
FIG. 5*b* shows a laminated microstructure of a hot pressed disk-shaped sample made using MgO-coated iron-6.5 wt. % Si steel flake-shaped particles. Both microstructures are shown comprising laminated soft magnetic regions (formerly the coated flake-shaped particles) that are substantially encapsulated by the electrically insulating layer (formerly the electrically insulating particle coating) between adjacent soft magnetic regions.
Figure 5A:
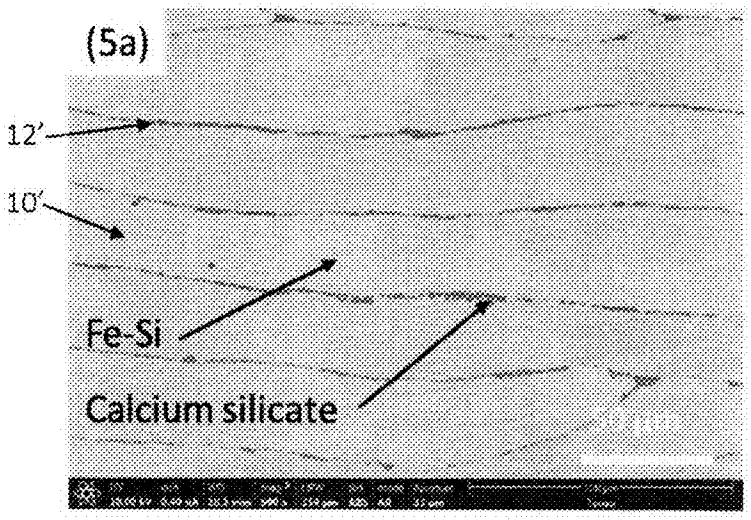
FIG. 5*a* shows a layered microstructure of a hot pressed disk-shaped sample made using $CaF_2$-coated iron-6.5 wt. % Si steel flake-shaped particles.

FIG. 4*a*, 4*b* show the photographs of the hot pressed samples having a simple cylindrical disk shape after receiving a surface polish. The hot pressed bulk samples have a well-defined bulk shape with excellent surface quality. FIGS. 5*a* and 5*b* show the layered microstructures of the hot pressed bulk samples after hot pressing. The layered microstructures comprise laminated soft magnetic regions 10' (formerly the coated flake-shaped particles 10") that are substantially encapsulated by the electrical insulating layer 12' (formerly the electrically insulating coating 12'). All of the flake-shaped particles are laminated, and the resulting soft magnetic regions 10' are effectively separated by the thin electrically insulating layer 12'. The laminated soft magnetic regions 10' are characterized as thin, flattened, elongated discreet regions having a high aspect ratio (ratio of average width or length, whichever is greater, to the average thickness) in the range of 10 to 250 as a result of hot pressing of the flake-shaped particles. No macroscopic pores are present in the samples, indicating good densification.

Other embodiments of the invention are not limited to hot pressing as described above and can be practiced using other typical powder consolidation techniques such as cold isostatic press followed by sintering, spark plasma sintering, hot isostatic pressing, shock compaction in order to form a consolidated bulk shape.

The resistivity of the laminated bulk samples of FIGS. 5*a* and 5*b* was subsequently measured by four point probe method. The resistivity of hot pressed $CaF_2$-coated flake-shaped particle bulk sample increased to 322.5 μΩ-cm, and the MgO-coated flake-shaped particle bulk sample increased to 510.1 μΩ-cm. These values compare to 80.9 μΩ-cm measured for a hot pressed bulk comparison sample without any particle coating. The results demonstrate that the electrical resistivity of the hot pressed bulk samples made pursuant to embodiments of the invention has been significantly improved, showing great potential to reduce eddy current loss. The resistivity of the bulk samples may be further improved by tuning the coating coverage and coating thickness on the flake-shaped particles in order to fully coat the flake-shaped particles with a layer that is sufficient to electrically insulate the particles from one another in the bulk sample and with the layer being thin enough so as to minimize its effect on diluting the magnetic properties. The chemistry of the coating, the method of the coating, the duration of the coating, and the conditions of the hot pressing can be chosen to this end.

Permeability is the ratio B/H where B is flux density and H is applied magnetic field. Permeability and is a key figure of merit for soft magnetic materials with higher permeability being preferred for higher efficiency of energy conversion. Permeability is adversely affected by demagnetization field and geometry. For example, the theoretical demagnetization factor for powder granules with spheroid shape having an aspect ratio of one (1) has been calculated as 0.333. For particles with a rectangular prism shape having an aspect ratio of ten (10), the theoretical demagnetization factor has been calculated as 0.046 as described in reference 7.

Flake-shaped particles produced pursuant to illustrative embodiments of the present invention advantageously have smaller demagnetization factor than granular powders. This advantage has been demonstrated in further experiments where epoxy bonded cores were made from conventional granular powder (e.g. powder granules with particle diameters of about 100 μm) and epoxy bonded cores were made from flake-shaped particles according to embodiments of the invention where the flake-shaped particles 10" (see FIG. 2*b*) had a typical geometry of 2 mm width by 2 mm length by 0.1 mm (100 μm) thickness providing a particle aspect ratio of 2 min/0.1 mm=20. For each type of core, the respective granular particles or flaked-shaped particles according to embodiments of the invention were added to and thoroughly mixed with respective 5 wt % epoxy/acetone solution obtained by dissolving a measured amount of the epoxy in acetone. The coated particles are then removed and dried to obtain respective coated granular particles as a comparison and coated flaked-shape particles pursuant to embodiments of the invention. The coated particles of each type were loaded into a respective ring-shaped die and then uniaxially pressed at room temperature using a hydraulic press with a 2-3 tons of force. The resulting pressure on the ring shaped sample was 50-75 MPa. Each pressed ring shaped sample was demolded from the die cured in air at 150 degrees C. for 30 minutes. The DC permeability of each pressed ring-shaped core sample was then measured by vibrating sample magnetometer apparatus. The measured DC permeability displayed for the flake-containing core sample pursuant to embodiments of the invention was 86.75 and much larger than the DC permeability of 35.90 of the comparison granular powder-containing core sample. Moreover, the flake-containing core also displayed lower iron losses up to 1000 Hz due to its higher permeability.

Further embodiments of the present invention involve producing a composite soft magnetic bulk structure for use in electrical transformers, generators, motors, sensors, inductors, and alternators. The composite bulk structure includes a plurality of stacked consolidated layers 20' having the aforementioned layered microstructure (including the laminated soft magnetic regions 10' that are substantially encapsulated by an electrically insulating layer 12' between adjacent soft magnetic regions) and being separated from the next adjacent stacked consolidated layer 20' by a relatively thick electrically insulating inter-layer 30' to form a near net shape soft magnetic bulk part with improved mechanical integrity.

Figure 6:
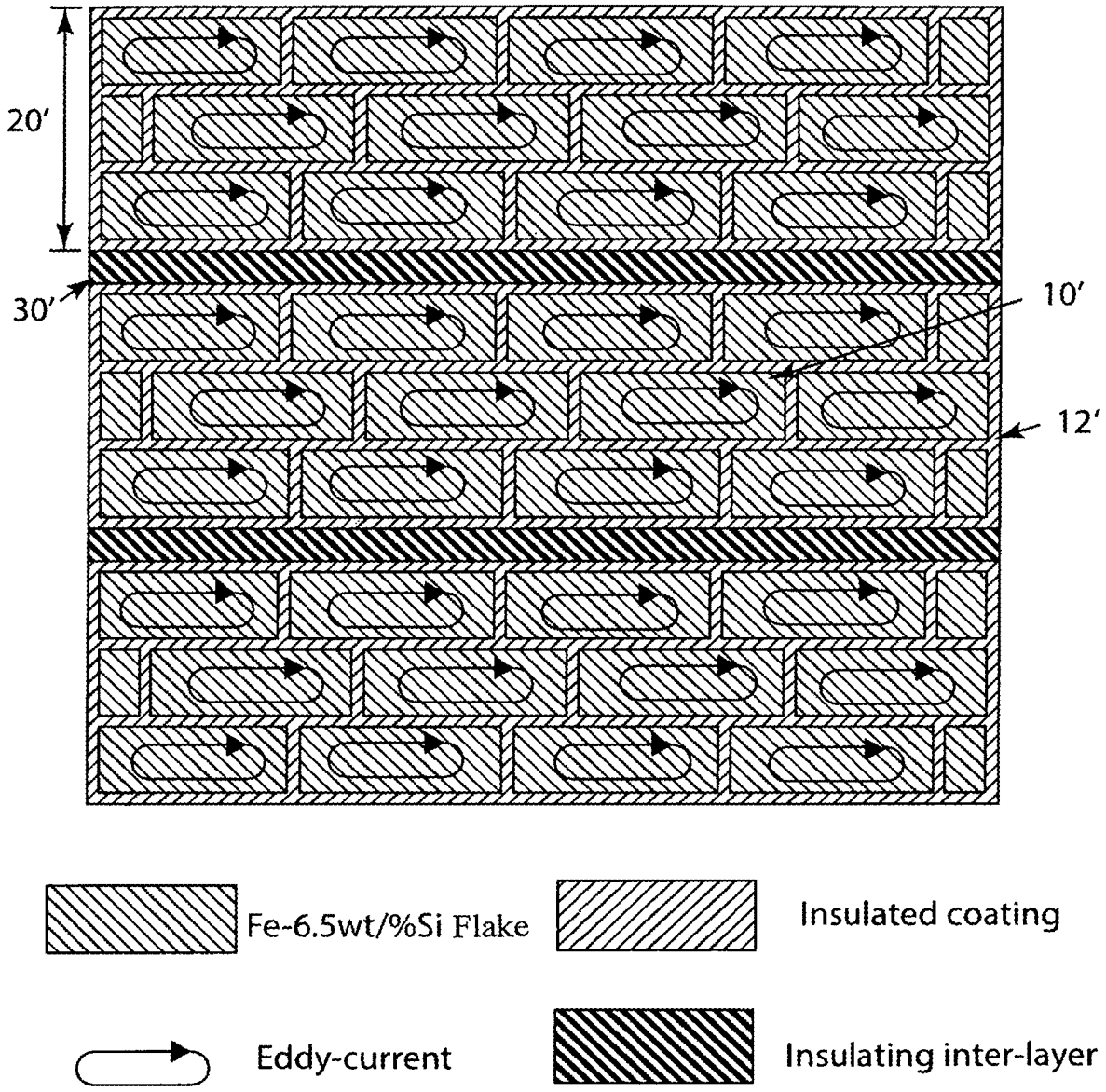
FIG. 6 shows a bulk magnet "brickwall" structure comprising a plurality of stacked consolidated layers having the layered microstructure with each consolidated layer separated from the adjacent consolidated layer by respective thick electrically insulating inter-layer, all of these layers being collectively consolidated to form a near net shape bulk magnet part. The path of eddy currents is illustrated.

FIG. 6 shows an illustrative embodiment wherein a plurality of the consolidated layers 20' are stacked in a die of appropriate shape and separated by the thick electrically insulating inter-layer 30', such as an oxide or other electrical insulating layer. The thickness of the insulating layers 30' is relatively thicker (e.g. a thickness of 0.01 mm to 0.2 mm) than that (e.g. 0.1 μm to 50 μm such as 50 μm) of the electrically insulating layer 12' that substantially encapsulates the soft magnetic regions 10'. For purposes of illustration and not limitation, each consolidated layer 20' can be 150 μm thick. The consolidated layers 20' and insulating inter-layers 30' can be cold or hot pressed together using a heated (if hot pressed) die/plunger to form the near net shape soft magnetic bulk part for use in electrical transformers, generators, motors, sensors, inductors, and alternators.

Although the present invention has been described above with respect to certain illustrative embodiments, those skilled in the art will appreciate that the invention is not limited to these embodiments and that changes and modifications can be made therein within the scope of the invention as set forth in the appended claims.

REFERENCES, which are incorporated herein by reference:

1. G. Ouyang, X. Chen, Y. Liang, C. Macziewski, J. Cui, "Review of Fe-6.5 wt % Si high silicon steel—A promising soft magnetic material for sub-kHz application," Journal of Magnetism and Magnetic Materials, 481 234-250 (2019)
2. T. Ros-Yanez, Y. Houbaert, O. Fischer, and J. Schneider, "Production of high silicon steel for electrical applications by thermomechanical processing," Journal of Materials Processing Technology, 141 [1] 132-37 (2003).
3. G. Ouyang, B. Jensen, W. Tang, K. Dennis, C. Macziewski, S. Thimmaiah, Y. Liang, J. Cui, "Effect of wheel speed on magnetic and mechanical properties of melt spun Fe-6.5 wt. % Si high silicon steel", AIP Advances. 8 056111 (2018).
4. H.-Z. Li, X.-L. Wang, H.-T. Liu, Z.-Y. Liu, and G.-D. Wang, "Microstructure, Texture Evolution, and Magnetic Properties of Strip-Casting Nonoriented 6.5 wt. % Si Electrical Steel Sheets With Different Thickness," IEEE Transactions on Magnetics, 51 [11] (2015).
5. T. Yamaji, M. Abe, Y. Takada, K. Okada, and T. Hiratani, "Magnetic properties and workability of 6.5% silicon steel sheet manufactured in continuous CVD siliconizing line," Journal of Magnetism and Magnetic Materials, 133 [1-3] 187-89 (1994).
6. J. A. Bas, J. A. Calero, and M. J. Dougan, "Sintered soft magnetic materials. Properties and applications," Journal of Magnetism and Magnetic Materials, 254 391-98 (2003).
7. A. Aharoni, "Demagnetizing factors for rectangular ferromagnetic prisms," Journal of Applied Physics, 83, 3432 (1998).

We claim:

1. Discontinous, flake-shaped melt spun solidified particles comprising a soft magnetic material and having an electrically insulating coating on the solidified particles, wherein substantially all of the solidified particles have substantially the same as-solidified quadrilateral flake shape with four as-solidified peripheral edges.

2. The particles of claim 1, which comprise at least one of pure iron, iron silicon alloy, iron nickel alloy, and iron cobalt alloy and have a grain size greater than 0.05 mm.

3. The particles of claim 1, which comprise an electrical steel having a silicon content of about 3 weight % to about 6.5 weight % si and balance Fe.

4. The particles of claim 1 wherein the coating comprises an inorganic or organic layer.

5. The particles of claim 1 having a particle aspect ratio of at least about 10.

6. The particles of claim 1 characterized as having a thin-peripheral edge in the particle thickness direction and opposite major particle sides of relatively large area compared to that of the edge wherein the edge has an average thickness of 0.02 to 0.2 mm and the major side surfaces each has an average width of 0.5 to 3 mm and an average length of 1 to 5 mm.

7. A consolidated soft magnetic shape having a layered microstructure comprised of the flake-shaped particles of claim 1 consolidated to provide laminated soft magnetic regions that are each substantially encapsulated by an electrical insulating layer to increase electrical resistivity of the consolidated soft magnetic shape.

8. The shape of claim 7 wherein the soft magnetic regions comprise at least one of pure iron, silicon iron alloy, iron nickel alloy, and iron cobalt alloy and have a grain size greater than 0.05 mm.

9. The shape of claim 7 wherein the layer comprises an organic or inorganic layer.

10. The shape of claim 7 wherein the electrically insulating layer has a thickness of 0.1 to 50 μm.

11. The shape of claim 7 which is consolidated to a density of at least about 80%.

12. The shape of claim 7 which is layer shape or three dimensional shape.

13. A composite soft magnetic bulk structure, comprising a plurality of stacked consolidated layers wherein each stacked layer comprises a layered microstructure comprised of the flake-shaped particles of claim 1 consolidated to provide laminated soft magnetic regions that are substantially encapsulated by an electrical insulating layer to increase electrical resistivity of the composite soft magnetic bulk structure and wherein each stacked layer is separated from the next adjacent stacked layer by an electrically insulating inter-layer devoid of magnetic particles to form a near net shape bulk magnet shape.

14. The structure of claim 13 wherein each electrically insulating inter-layer between the stacked layers has a thickness of 0.01 mm to 0.2 mm.

15. The bulk structure of claim 13 wherein each electrically insulating inter-layer between the stacked layers has a thickness of 0.01 mm to 0.2 mm.

16. The bulk structure of claim 13 wherein the soft magnetic regions comprise pure iron or an electrical steel composition and have a grain size greater than 0.05 mm.

17. The bulk structure of claim 13 residing in an electric transformer, electric generator, electric motor, inductors, or alternator.

18. A consolidated soft magnetic shape having a layered microstructure comprised of the flake-shaped particles of claim 3 consolidated to provide laminated soft magnetic regions that are each substantially encapsulated by an electrical insulating layer to increase electrical resistivity of the consolidated soft magnetic shape.

* * * * *